US006062505A

United States Patent [19]

Bartkowiak

[11] Patent Number: 6,062,505

[45] Date of Patent: May 16, 2000

[54] YARN WINDING METHOD AND APPARATUS

[75] Inventor: Klaus Bartkowiak, Herne, Germany

[73] Assignee: Barmag AG, Remscheid, Germany

[21] Appl. No.: 09/079,593

[22] Filed: May 15, 1998

[30] Foreign Application Priority Data

May 15, 1997 [DE] Germany ..... 197 20 373
Jul. 17, 1997 [DE] Germany ..... 197 30 633

[51] Int. Cl.[7] ..... B65H 54/00; B65H 54/22; B65H 75/18

[52] U.S. Cl. ..... 242/470; 242/474.5; 242/596.8; 242/486.2

[58] Field of Search ..... 242/474.5, 474.6, 242/486.2, 486.4, 481.7, 596.8, FOR 134, FOR 165

[56] References Cited

U.S. PATENT DOCUMENTS

| | | | |
|---|---|---|---|
| 1,992,757 | 2/1935 | McKean | 242/486.2 X |
| 3,575,356 | 4/1971 | Campbell | 242/486.2 |
| 3,883,082 | 5/1975 | Gritschke et al. | 242/486.4 |
| 3,940,074 | 2/1976 | Laski et al. | 242/486.2 |
| 5,018,677 | 5/1991 | Fahmuller | 242/486.4 X |
| 5,029,762 | 7/1991 | Behrens et al. | 242/474.5 |
| 5,100,072 | 3/1992 | Behrens et al. | 242/474.5 |
| 5,692,367 | 12/1997 | Stahlecker | 242/486.2 X |

FOREIGN PATENT DOCUMENTS 32 07 375 10/1982 Germany .

*Primary Examiner*—Donald P. Walsh
*Assistant Examiner*—Collin A. Webb
*Attorney, Agent, or Firm*—Alston & Bird LLP

[57] ABSTRACT

A yarn winding method and apparatus which is able to suppress vibrations of the package being formed, and which includes a package support spindle and a contact roll which engages the surface of the package. The support spindle and the contact roll are moveable relative to each other during the build of the package so as to accommodate its increasing size, and the mounting structure for the package support spindle or the contact roll is sequentially gripped and released so that the relative movement occurs discontinuously.

21 Claims, 6 Drawing Sheets

YARN WINDING METHOD AND APPARATUS

BACKGROUND OF THE INVENTION

The present invention relates to a method and apparatus for winding a continuously advancing yarn into a yarn package.

When winding a continuously advancing yarn into a package against whose circumference a contact roll bears with a contact force, the build of the package is accommodated by a yielding movement of the package or a yielding movement of the contact roll. DE 40 18 095 and corresponding U.S. Pat. No. 5,100,072 disclose a winding mechanism for winding freshly spun yarn in which the yielding movement of the package support is regulated during the winding run in accordance with the position of the contact roll. In this case, the package support comprises a spindle which is rotatably mounted on a rotatable revolver, and the yielding movement of the support spindle is achieved by rotating the revolver. The contact roll is mounted on a pivotable support, so that it can execute a movement in the radial direction with respect to the package during the winding run. The movement of the contact roll support is sensed and fed to a control device, which causes the revolver to rotate with the support spindle in accordance with the travel of the contact roll.

The package support spindle of winding machines of this kind is subject to vibrations during winding, in particular in the lower rotational speed range of <2,000 rpm, which severely disturb the package winding operation. Moreover, the radial movement of the contact roll results in a further increase in vibrations of this kind.

DE 32 07 375 discloses a winding mechanism for winding yarn in which the package support is pivotably mounted by means of a pivot shaft. The known winding mechanism is primarily employed in texturing machines at yarn speeds of up to 1,200 m/min. A package holder is disposed at the free end of the support to take up the package. The package bears against a stationary, driven contact roll. During the winding process, the increasing package diameter causes the package support to move radially with respect to the contact roll. Because the package support can move freely, this arrangement may also suffer vibrations which are unchecked and have a significant detrimental effect on the winding process. Although it is known to damp the movement of the package support in the direction of movement in winding mechanisms of this kind, this case entails the problem of high hysteresis forces, which result in significant variations in the contact force between the contact roll and the package surface, when a vibration-induced reversal of movement occurs.

It is accordingly an object of the invention to provide a method and apparatus for winding a continuously advancing yarn in which a substantially hysteresis-free damping of the yielding movement of the freely movable support (package support or contact roll support) takes place when winding a package, so that winding can also be carried out at extremely low winding speeds.

SUMMARY OF THE INVENTION

The above and other objects and advantages of the present invention are achieved by the provision of a yarn winding method and apparatus which includes winding the advancing yarn onto a bobbin tube which is rotatably supported on a support and so as to form a wound package on the bobbin tube. The surface of the package being formed is engaged by a contact roll which is rotatable about an axis parallel to the axis of the supported bobbin tube, and the contact roll and the support are mounted for limited relative movement such that the center to center distance between the supported bobbin tube and the contact roll is increased as the package builds. In addition, at least one of the contact roll and the package support is sequentially gripped and released so that the relative movement occurs discontinuously.

It has become apparent that the build-up of vibrations at, for example, a stationary package support can be decisively influenced by the mobility or rigidity of the contact roll. The vibrations of the stationary package support are damped to a very large extent if the contact roll is immobile in the radial direction. The method according to the invention has the advantage of achieving a high degree of damping of the vibrations at the support spindle without any loss of mobility of the contact roll. The movement of the contact roll is only intermittently disturbed by the pulsed gripping of the contact roll support. During gripping of the roll support all kinetic energy is nullified and cannot therefore cause a build-up of vibrations.

A further advantage of the invention lies in the fact that this damping is hysteresis-free, as it is not dependent on direction. The invention can therefore also be employed to particular advantage in designs with a stationary contact roll or stationary roll support and a freely mobile support spindle. As soon as the support spindle ceases to be gripped, the displacement-force equilibrium between the contact roll and the package which is required to form the package is automatically established.

In one embodiment of the invention, the gripping force allows the support to move with finite friction which is produced during gripping. This is of particular advantage for achieving a high degree of uniformity of the contact pressure between the contact roll and the package. In this case the friction absorbs the vibrational energy.

However a maximum degree of damping can be achieved in an embodiment in which the gripping forces are applied during gripping which are so high that they bring the support to a complete standstill. All forms of vibration are completely suppressed in this case.

The pulsed gripping of the support may take place according to a time program with a constant gripping period and a constant release period, and a continuous alternation between gripping and release of the support takes place. It is thereby possible to prevent vibrations from building up at the contact roll during the entire winding run. The vibrations of the support spindle are equally controlled substantially with the same damping during the entire winding run.

The time program may have a variable period. This has the special advantage of enabling the damping to be varied during the winding run. Optimum damping can thereby be achieved for each rotational speed or each package diameter. Thus a relatively long period may be selected at the beginning of the winding run. The period defines the time during which the contact roll or the support spindle is gripped once and released again. The pulse time, i.e, the gripping time, is minimized concurrently with the long period. The mobility of the contact roll or the support spindle required on account of the rapidly increasing package diameter is thus guaranteed.

The pulse time during which the contact roll or the support spindle is gripped may be longer than the interval time during which the member is released. This process is preferably used in the lower support spindle rotational speed range. As the circumferential speed of the package and thus the rotational speed of the contact roll remain substantially constant during the winding run, the lower rotational speeds of the support spindle only occur with correspondingly large package diameters. In this case the increase in the package diameter in time is correspondingly small, so that the damping action of the contact roll is prominent with respect to the mobility of the latter.

The gripping force for gripping the member may be built up with a delay. This is advantageous for producing additional frictional damping. A damping force can therefore be produced while the contact roll is still moving.

In one embodiment, the support spindle and the contact roll are both movable, and the support spindle is driven while the contact roll support is gripped in a pulsed manner. This embodiment is particularly advantageous for enabling yarn to be wound at a high speed exceeding 6,000 m/min.

An advantage of the winding method and apparatus according to the invention lies in the fact that it can be operated with low vibration levels in the entire rotational speed range and packages with a uniform package build-up can in this connection be produced. The gripping mechanism which is used to grip the roll support or the support spindle can here be effected mechanically, electrically or electropneumatically. The gripping mechanism may be actuated via a pulse generator. The appropriate time programs are determined by means of the pulse generator of the gripping mechanism according to the method which is used.

The gripping mechanism may be controlled in accordance with the respective position of the support spindle or package diameter. For this purpose the pulse generator is connected to the control device, which controls the yielding movement to increase the center distance between the contact roll and the support spindle.

The control device may be programmed so that the movable contact roll bears uniformly against the entire length of the package surface during the entire winding run. It is impossible for any unevenness at the package surface or misalignment between the contact roll and the support spindle to have negative consequences. The effect can be further augmented by actuating the gripping mechanisms at both ends of the contact roll in opposite directions. In this respect the contact roll is not entirely torsion-proof.

In one preferred embodiment, the contact roll or the support spindle is pivotally mounted to the machine frame by means of a rocker, and the rocker mounts a pin which engages in a gripping mechanism. The pin can thus be fixed by an electrical or mechanical gripping mechanism such that the rocker cannot pivot relative to the machine frame.

The gripping mechanism may be composed of two gripping jaws which can move towards one another and an actuator, with the gripping jaws enclosing the pin. A gripping mechanism of this kind is characterized by a high level of functional reliability. It is, however, also possible for the gripping mechanism to comprise an electromagnet which acts directly on the rocker.

The invention is accordingly able to suppress all forms of vibration in the components relevant to the formation of the package. The damping produced in this respect is made possible by the cyclic gripping without hysteresis phenomena. All kinetic energy is nullified in the gripping phases of the cycles, while the displacement-force equilibrium, which would also be expected without damping, can be established in the free phases. Hysteresis and direction of movement dependencies are absent. The gripping-free phases are advantageously of such short duration that it is impossible for a vibration to build up. The gripping phases are selected in accordance with the package diameter such that the movement of the contact roll is not hindered in a negative way.

BRIEF DESCRIPTION OF THE DRAWINGS

Some of the objects and advantages of the invention having been stated, others will appear as the description proceeds, when considered in conjunction with the accompanying drawings, in which.

DETAILED DESCRIPTION OF THE PREFERRED EMBODIMENTS

Figure 1:
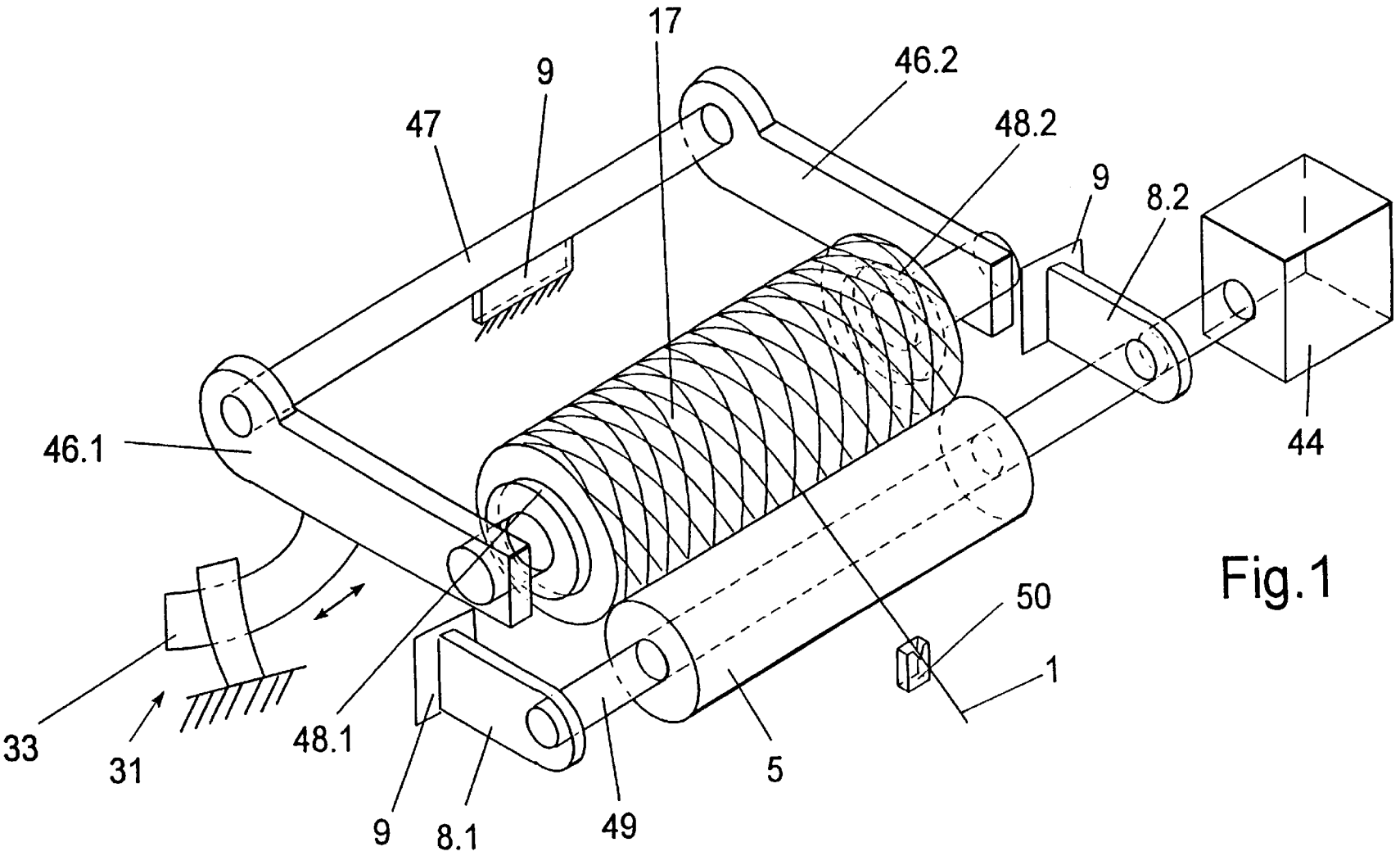
FIG. 1 is a diagrammatic view of a first embodiment of a winding apparatus according to the invention.

FIG. 1 shows a first embodiment of a winding apparatus according to the invention, as may be used, for example, in a texturing machine. The spindle supports 46.1 and 46.2 are pivotably mounted at a distance from one another on a pivot shaft 47 disposed on the machine frame 9. A package holder in the form of a centering plate 48.1 is rotatably mounted at the free end of the spindle support 46.1. A package holder in the form of a centering plate 48.2 is likewise rotatably mounted at the free end of the spindle support 46.2. A bobbin tube for taking up the package is clamped between the centering plates 48.1 and 48.2. A contact roll 5 bears against the surface of the package 17, and is secured to a drive shaft 49. The drive shaft 49 is rotatably mounted in the roll supports 8.1 and 8.2, which are rigidly connected to the machine frame 9. The drive shaft 49 is coupled at one end to the drive 44. The drive 44 and the drive shaft 49 drive the contact roll 5 such that the contact roll 5 rotates at a constant circumferential speed during the winding run. A traversing yarn guide 50, which is moved to-and-fro within a traversing stroke paraxially with the package by means of a traversing drive (not shown), is disposed before the contact roll 5.

During winding, a yarn 1 is fed to the winding machine at a constant speed. The yarn 1 is initially guided through the traversing yarn guide 50 and runs from the latter onto the contact roll 5 and is deposited on the package surface. The increasing diameter of the package 17 causes the spindle support 46 to pivot at the pivot shaft 47 radially with respect to the contact roll. A pin 33 is fixed to the spindle support 46.1, and the pin 33 engages in a gripping mechanism 31. The pin 33 is gripped cyclically in the gripping mechanism 31. The structure and operating mode of the gripping mechanism 31 are described below.

In order to achieve uniform contact between the package 17 and the contact roll 5, it is advantageous to connect both spindle supports 46.1 and 46.2 to a respective gripping mechanism. In this case the gripping mechanisms are preferably activated in synchronism., i.e., the gripping and the release of the supports take place simultaneously at both spindle supports.

Figure 2:
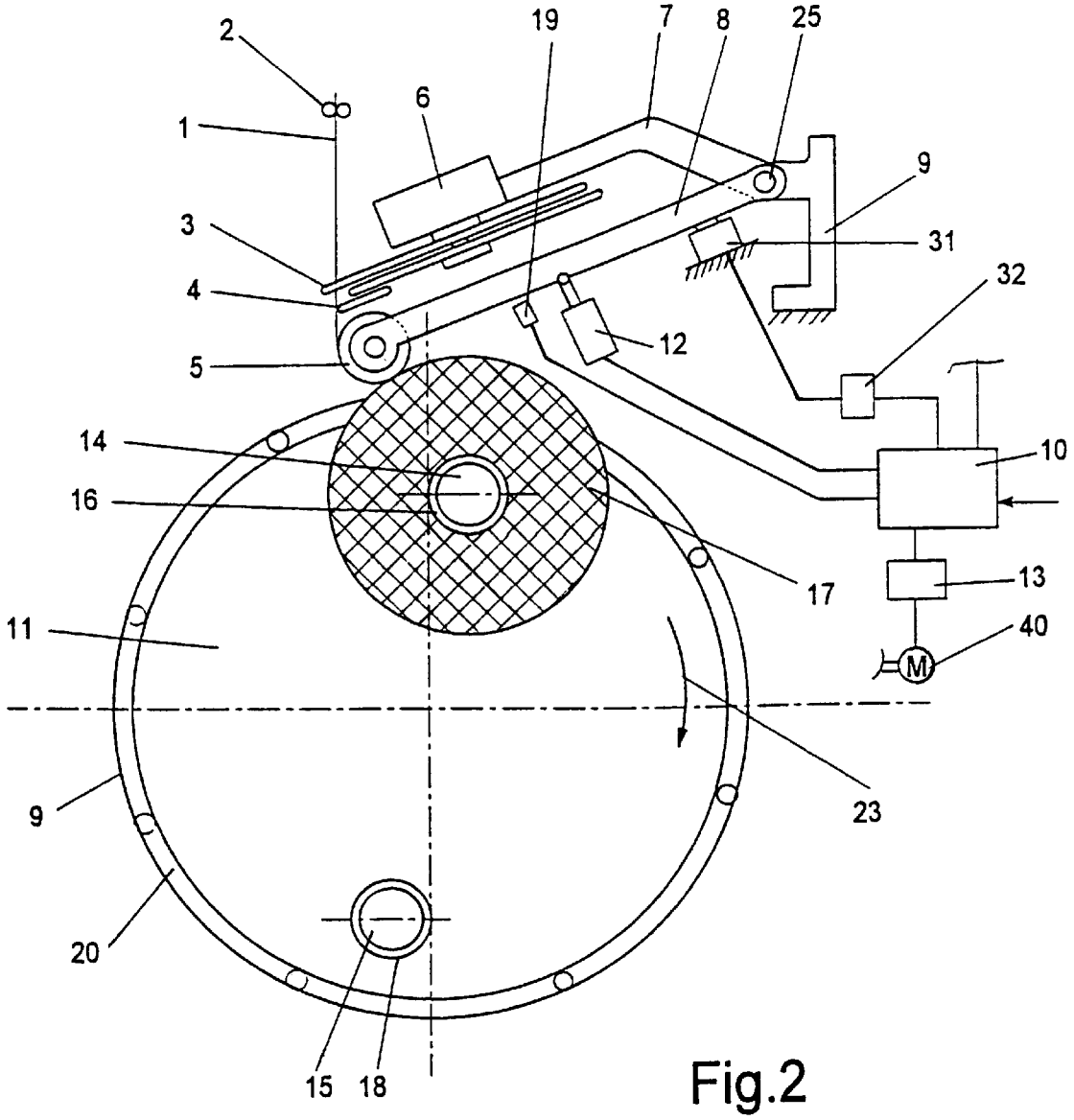
FIG. 2 is a diagrammatic side view of a second embodiment of a winding apparatus according to the invention.
Figure 3:
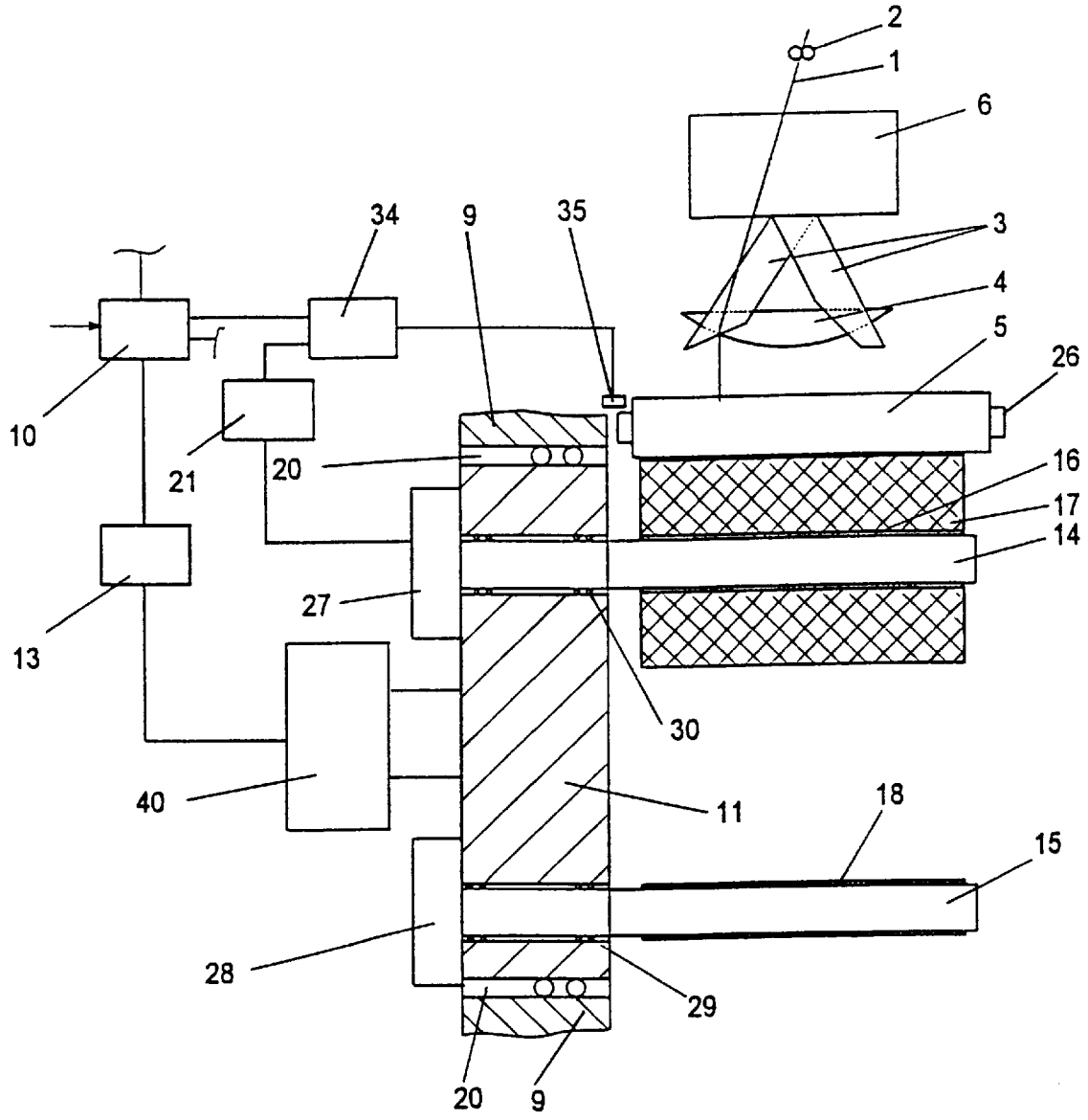
FIG. 3 is a diagrammatic front view of the winding apparatus shown in FIG. 2.

A second embodiment of the winding apparatus according to the invention shown in FIGS. 2 and 3. This winding apparatus is used in particular to wind freshly spun yarn, with winding speeds of 1,800 m/min. to 6,000 m/min. A yarn 1 is delivered to the winding apparatus at a constant speed. The yarn 1 is initially guided through the head yarn guide 2, which forms the apex of the traversing triangle. The yarn then passes to a traversing device, which in the illustrated embodiment comprises a traversing drive 6 and flyers 3 of known construction. The flyers 3 guide the yarn 1 alternately to-and-fro along a guide bar 4 within the limits of a traversing stroke. For this purpose the flyers are secured to two rotors which are driven in opposite directions. The traversing device is mounted in a movable manner to the machine frame 9 of the winding apparatus via a support 7, to the free end of which the traversing device is secured and which is pivotably mounted at the other end such that the traversing device can execute a movement perpendicularly to itself and to the contact roll 5, i.e, a parallel displacement.

Downstream of the traversing device the yarn is deflected at the contact roll 5 by more than 90° and then wound up on the package 17. The package 17 is formed on the bobbin tube 16 which is mounted on a package holder formed as a freely rotatable support spindle 14. The support spindle 14 is disposed with the bobbin tube 16 mounted thereon and the package 17 is formed on the latter in the winding region.

The support spindle 14 is rotatably mounted in a projecting manner on a rotatable support 11. The rotatable support 11 is in this case constructed as a winding revolver, on which a second support spindle 15 is mounted in a projecting eccentric manner such that it is offset by 180° with respect to the first support spindle 14. The winding revolver 11 is rotatably mounted in the bearing 20 in the machine frame 9. The winding revolver 11 is driven by an electric motor 40. FIG. 2 shows that the support spindle 14 is in the operating position in the winding region and the support spindle 15 is in a stand-by position in a changeover region of the winding mechanism.

As seen in FIG. 3, the support spindle 14 is mounted to the winding revolver 11 by means of the bearing 30. The support spindle 14 is driven by a winding spindle drive 27 constructed, for example, as a synchronous motor. The winding spindle drive 27 is secured to the winding revolver 11 in alignment with the support spindle 14. The winding spindle drive 27 is supplied with three-phase current of controllable frequency via an inverter 21. The inverter 21 is actuated by a control instrument 34, which is actuated by a rotational speed sensor 35. The rotational speed sensor 35 senses the rotational speed of the contact roll 5. The inverter 30 of the support spindle 14 is controlled by the control instrument 34 such that the rotational speed of the contact roll 5 and thus also the surface speed of the package 17 remain constant, in spite of an increasing package diameter.

The second support spindle 15 is rotatably mounted to the winding revolver 11 via a bearing 29 and is driven by means of a winding spindle drive 28. The winding spindle drive 28 is deactivated at the position illustrated, since the support spindle 15 is in readiness for exchanging a full package for an empty tube 18.

The winding revolver 11 is rotatably mounted in the machine frame 9 of the winding apparatus and is driven in the rotational direction 23 by the electric motor 40. The electric motor 40 is constructed as an asynchronous motor, for example. The electric motor 40 serves to rotate the winding revolver 11 in the direction of the increasing package diameter. The center to center distance between the contact roll 5 and the support spindle 14 then increases, although the position of the contact roll 5 remains substantially unchanged. The electric motor 40 is for this purpose actuated via an inverter 13.

According to FIG. 2 the contact roll 5 is mounted to a roll support arm 8, which is formed as a rocker which is pivotably mounted at one end to a pivot shaft 25 on the machine frame 9. The contact roll 5 is secured to the free end of the arm 8. The contact roll 5 bears against the circumference of the package 17, and is thus moved away in the radial direction with respect to the package 17 as the package diameter increases. A position sensor 19 is disposed below the arm 8. The position sensor 19 detects the travel of the contact roll 5 or the pivot angle of the arm 8 relative to the machine frame 9. The sensor 19 is connected to a drive control device 10, which is also coupled to the inverter 13.

A gripping mechanism 31 is secured to the machine frame 9 and connected to the arm 8. The gripping mechanism 31, which will be described in greater detail below, is actuated via a pulse generator 32. The pulse generator 32 is connected to the drive control device 10. The control device of the gripping mechanism may, however, also be connected independently of the drive control device.

The operating mode of the above-described winding apparatus of FIGS. 2–3 will now be described. The package 17 is wound on the tube 16. As the package diameter increases, the contact roll 5 on the arm 8 is initially moved in the radial direction relative to the machine frame. This movement is detected by means of the sensor 19 and delivered to the control device 10. The control device 10 will then actuate the electric motor 40 via the inverter 13 such that the winding revolver 11 is rotated in the rotational direction 23 until the contact roll 5 or the arm 8 has returned to its original starting position. During the movement of the contact roll, the gripping mechanism 31 is at the same time actuated via the pulse generator 32 such that the arm 8 is repeatedly gripped according to a predetermined time sequence. The arm 8 is gripped in a pulsed manner, so that the gripping and the release of the arm 8 take place in a constantly alternating manner. This means that the mobility of the arm 8 is not restricted. However the degree of freedom of the contact roll 5 is restricted in the radial direction such that no vibrations can occur at the contact roll 5. The vibrations of the support spindle 14 are in addition damped to a very large degree in the phase in which the arm 8 is gripped. It is thus possible to reduce the substantial vibrations occurring at the support spindle 14, in particular in the lower rotational speed range below 1,800 m/min., so as to permit a reliable build of the package 17. The gripping mechanism 31 is in this respect constructed such that the arm 8 can move away from the support spindle 14 and towards the support spindle 14.

It is, however, also possible for the control device 10 to set an appropriately programmed winding run sequence such that the gripping mechanism 31 is not activated in certain regions of the winding run. This method variant is of particular advantage when the package 17 is of a small diameter, as the increase in diameter in time presupposes a high degree of mobility of the contact roll 5, so that gripping of the arm 8 would result in changes in the contact force set between the contact roll 5 and the package 17.

As seen in FIG. 2, a relieving device 12 could also act on the arm 8 in order to finely adjust a basic value of the desired contact force between the contact roll and the package surface. The relieving device 12, which can be pneumatically loaded and acts from below against the weight of the arm 8, enables the weight which bears on the contact roll and thus as contact force on the package 17 to be fully or partly compensated. The relieving device 12 can be controlled via the control device 10.

Figure 4:
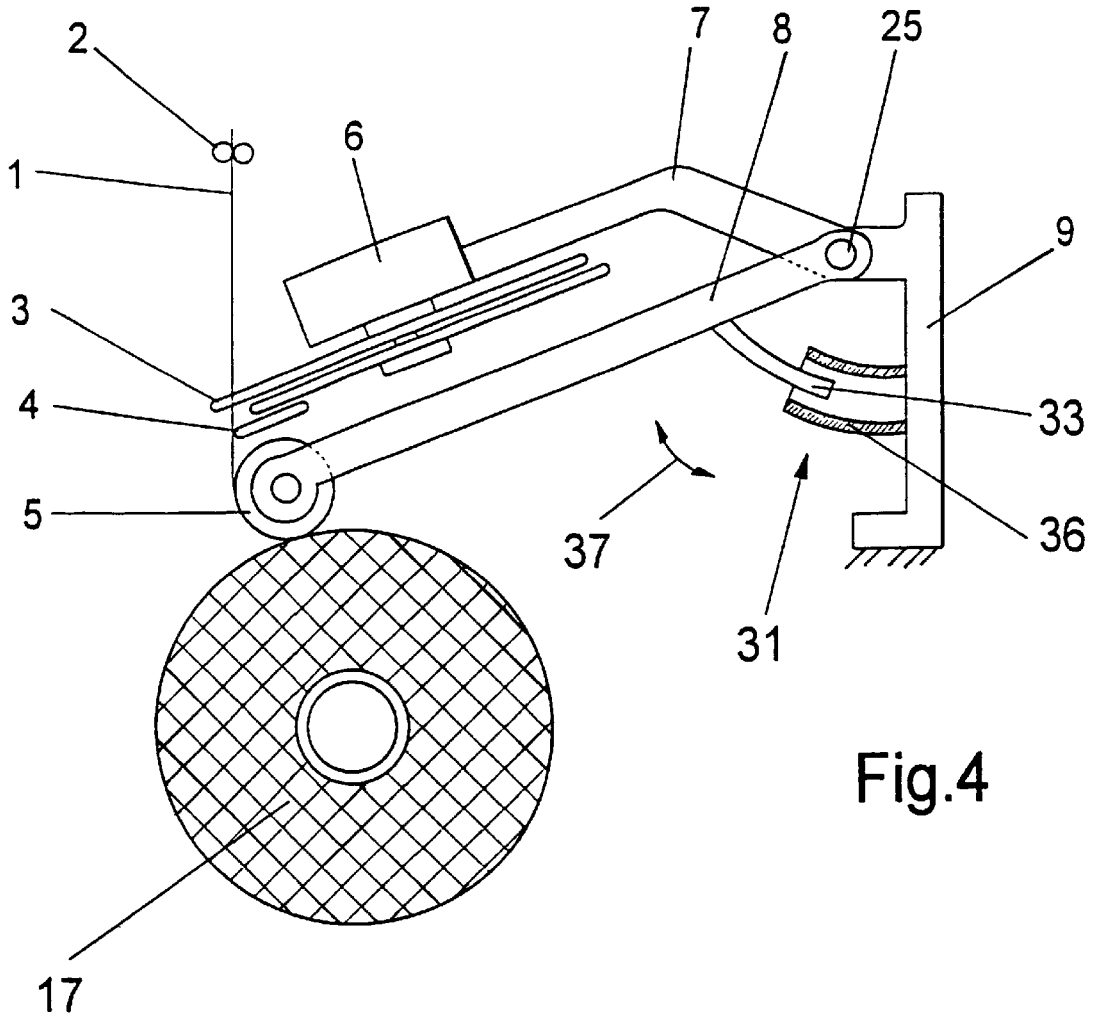
FIG. 4 is a diagrammatic view of a contact roll support with a mechanical gripping mechanism.
Figure 5:
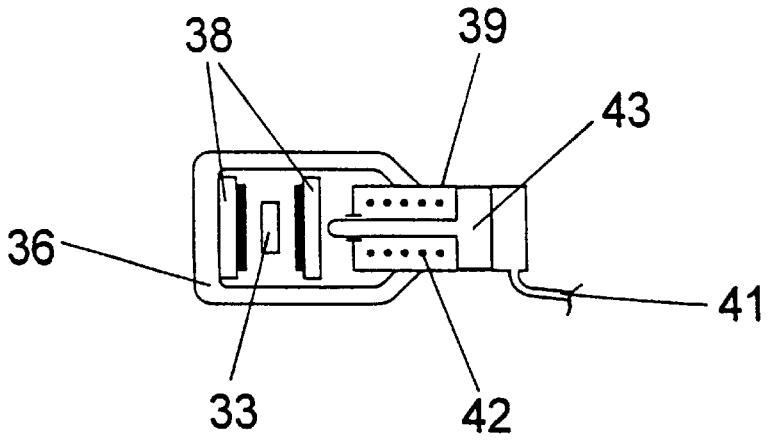
FIG. 5 is a diagrammatic view of a mechanical gripping mechanism with actuator.

FIGS. 4 and 5 show an embodiment of a gripping mechanism as would be used, for example, in a winding apparatus of FIG. 1 or FIG. 2. In this embodiment a pin 33 is firmly attached to the arm 8, and the pin 33 enters a hollow body 36 of the gripping mechanism 31. The hollow body 36 is secured to the machine frame 9. When the gripping mechanism 31 is in the released state the pin 33 can move freely in the hollow body 36 in either direction of movement 37. As shown in FIG. 5, a respective gripping jaw 38 is disposed within the hollow body 36 on both sides of the pin 33. The gripping jaws 38 can be moved towards each other. This is effected by an actuator 39, which is disposed in alignment with the gripping jaws 38. The actuator 39 can be pneumatically loaded via the control line 41. The control line 41 is connected to the pulse generator 32. A piston 43 is disposed inside the actuator 39 and when pneumatically loaded moves out against a spring 42 and pushes the gripping jaws 38 towards each other. The pin 33 is then gripped between the two gripping jaws 38 such that the arm 8 can no longer move, or only with a relatively high frictional component.

In order to make the connection between the member which is to be gripped and the gripping mechanism as rigid as possible, the gripping jaws can be secured directly to the machine frame. The pin 33 is then guided between the gripping jaws. The gripping force required is applied by an actuator acting on the gripping jaws in the gripping direction.

It is also possible, by developing the gripping jaw surfaces, for example by means of additional coverings, to set the gripping force such that, as from a certain maximum force, additional friction occurs between the pin 33 and the gripping jaws 38.

Figure 6:
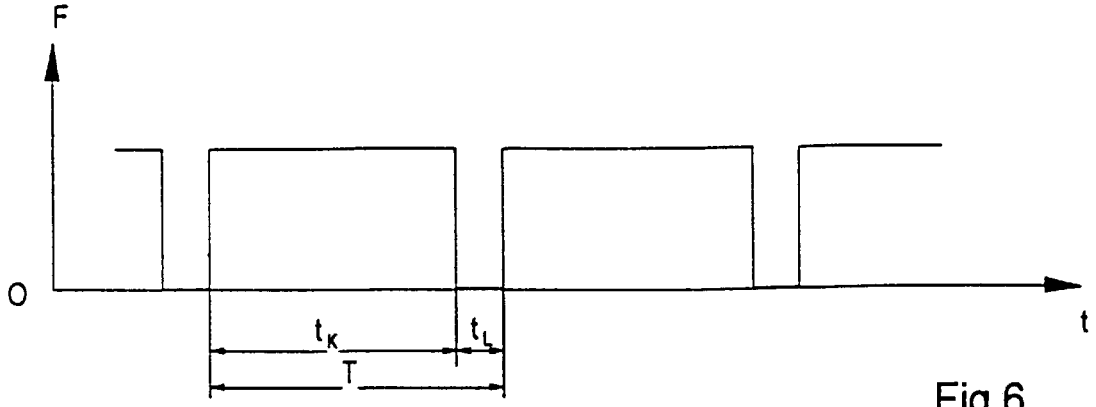
FIGS. 6 and 7 are pulse-interval diagrams of the gripping of the contact roll support.

FIG. 6 shows a pulse-interval diagram of the gripping of the arm 8. Here the time program is composed of constant periods T which are composed of constant pulse times $t_K$ and interval times $t_L$. The period T is the time during which the arm 8 is gripped once and released again. The gripping time in which the gripping force F is produced by the gripping mechanism is equal to the pulse time $t_K$. The time during which a free movement of the rocker takes place is equal to the interval time $t_L$. In this case, the period consists of the addition of both times. In this time program, the phase of gripping with a gripping force F applied is longer than the phase of free movement. Vibrations are as a result prevented on a long-term basis. The magnitude of the gripping force F is selected such that the vibration forces resulting at the contact roll or the rocker arm are always smaller than the gripping force which is set. This ensures that the rocker arm is securely held in the respective gripping phase.

It is also possible to program the control device so as to make the period T or the pulse time $t_K$ and the interval time tL variable in order to permit individual adaptation to the respective winding operation. It is therefore possible, especially where there is an increased risk of vibrations, to operate with appropriately long pulse times and appropriately short interval times. The maximum gripping force is in this case applied suddenly, so that no friction occurs. The gripping is therefore hysteresis-free and independent of the respective direction of movement of the contact roll.

Figure 7:
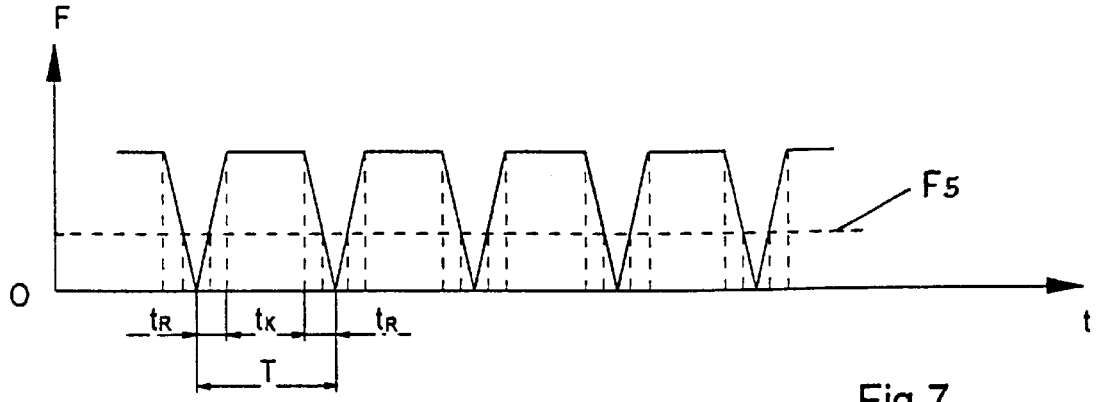

FIG. 7 shows a pulse-interval diagram in which the gripping force F is applied gradually, or with a delay within a period of time $t_R$. As the roll or package support is not gripped until the gripping force completely absorbs the energy built up through vibration, no friction occurs in the first phase while a gripping force is building up. The roll or package support comes to a standstill as soon as the gripping force F which has built up exceeds the vibration force $F_S$. The vibration force $F_S$ is plotted in FIG. 7. The interval time $t_L$ is infinitesimal in this embodiment. The period T results from the following relation:

$$T=t_K+2\times t_R.$$

This mode of procedure achieves a very high level of vibration damping.

Figure 9:
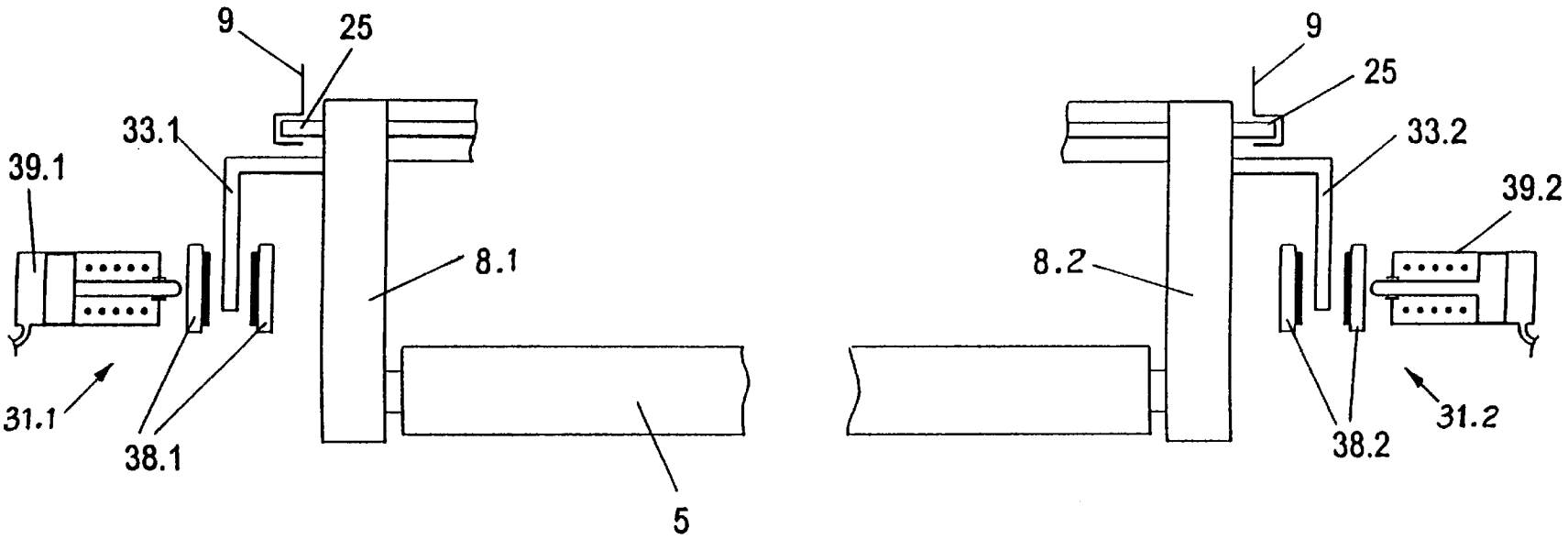
FIG. 9 is a diagrammatic view of a further embodiment of a contact roll support with two gripping mechanisms.

FIG. 9 shows another embodiment of a gripping mechanism as would be used for example in a winding apparatus according to FIGS. 2–3. Here the contact roll 5 is mounted between a pair of rocker arms 8.1 and 8.2, and a gripping mechanism 31.1 and 31.2 is associated with each of the arms 8.1 and 8.2. The gripping mechanism 31.1 comprises a pin 33.1 which is fixed to the arm 8.1, a pair of opposing jaws 38.1, and an actuator 39.1. The gripping mechanism 31.2 comprises a pin 33.2 which is fixed to the arm 8.2, a pair of opposing jaws 38.2, and an actuator 39.2. The structure of each gripping mechanism and its operating mode are identical to the structure and operating mode of the gripping mechanism depicted in FIGS. 4 and 5. The description relating to FIGS. 4 and 5 is referred to in this respect. The rocker arms 8.1 and 8.2 are pivotably mounted to the pivot shaft 25. The pivot shaft 25 is secured in a rotatable manner to the machine frame 9. If both gripping mechanisms of this gripping mechanism construction are activated at the same time, maximum damping is produced.

In the method variant in which the actuators 39.1 and 39.2 are loaded in opposite directions, the contact roll 5 bears uniformly against the package surface over its entire length. This variant is of particular advantage if a plurality of packages are to be simultaneously formed one behind the other on one support spindle. A contact roll which is approximately 1.5 m long is then used.

Figure 8:
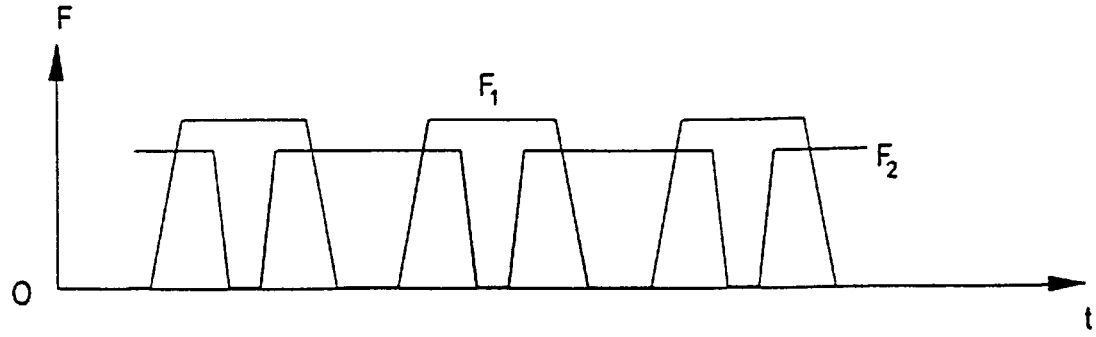
FIG. 8 is a pulse-interval diagram for a contact roll support having two gripping mechanisms.

FIG. 8 shows a pulse-interval diagram of the gripping forces of the two gripping mechanisms, representing the mechanisms operating in opposite directions. The roll support is in this case alternately gripped at one or the other end of the contact roll by the respective gripping mechanism. It is never possible for both ends of the contact roll to execute a free movement at the same time. All that is possible is a stepwise creeping movement in which the structure of the connections between the pin 33, the support 8 and the contact roll 5 must be elastic. Possible vibrations are thus permanently suppressed. However slow movements can be executed substantially unhampered.

The method and apparatus according to the invention are distinguished by their flexibility as regards vibration control. Any desired time functions for setting the recurrent gripping actions are possible. The period, i.e., the frequency, with which the gripping actions occur can be varied in the same way as the pulse time during which the roll or package support is gripped or the interval time during which the roll or package support can move freely.

The method according to the invention can equally be employed with a winding apparatus wherein the contact roll support is in the form of a carriage which can travel vertically. The gripping mechanism described here is, moreover, to be considered as an example. Any desired gripping mechanisms which are effected either electrically, mechanically, pneumatically or as a combination thereof can be used. The essential feature here is the possibility of alternating the gripping and the free movement of the roll support.

That which is claimed is:

1. A method of winding a continuously advancing yarn into a yarn package comprising the steps of winding the advancing yarn onto a bobbin tube which is rotatably supported on a package support and so as to form a wound package on the bobbin tube, engaging the surface of the package being formed with a contact roll which is rotatable about an axis parallel to the axis of the supported bobbin tube, with the contact roll and the package support being mounted for limited relative movement in a direction wherein the center to center distance between the supported bobbin tube and the contact roll is increased as the package builds, and sequentially gripping and releasing at least one of the contact roll and the package support so that the relative movement occurs discontinuously during movement in said direction.

2. The method as defined in claim 1 wherein the gripping and releasing step includes applying a gripping force which allows such relative movement with a finite friction.

3. The method as defined in claim 1 wherein the gripping and releasing step includes applying a gripping force which precludes any such relative movement.

4. The method as defined in claim 1 wherein the gripping and releasing step includes sequencing the gripping and releasing in accordance with a time program, and wherein the gripping time and the release time are each of constant duration.

5. The method as defined in claim 1 wherein the gripping and releasing step includes sequencing the gripping and releasing in accordance with a time program, and wherein the gripping time and the release time are each of variable duration.

6. The method as defined in claim 1 wherein the gripping and releasing step includes sequencing the gripping and releasing in accordance with a time program, and wherein the gripping time is longer than the release time.

7. The method as defined in claim 1 wherein the gripping and releasing step includes applying a gripping force so that the gripping force gradually increases to a maximum gripping force, and then gradually decreases.

8. The method as defined in claim 1 wherein the package support includes a bracket which is mounted for pivotal movement about an axis which is parallel to the rotational axis of the supported bobbin tube, and wherein the contact roll is mounted for rotation about a fixed axis which is parallel to the axis of the supported bobbin tube, and wherein the gripping and releasing step includes gripping and releasing said bracket.

9. The method as defined in claim 1 wherein the package support includes a spindle for coaxially receiving the supported bobbin tube and which is mounted to a revolver which is in turn mounted for rotation about an axis parallel to an axis defined by the spindle, and wherein the contact roll is rotatably mounted to a bracket which is mounted for pivotal movement about an axis which is parallel to the axis of the spindle, and wherein said gripping and releasing step includes gripping and releasing said bracket.

10. The method as defined in claim 1 wherein the contact roll and the package support are mounted for limited relative movement toward and away from each other, and wherein the step of sequentially gripping and releasing at least one of the contact roll and the package support occurs in each direction of relative movement.

11. An apparatus for winding a continuously advancing yarn into a yarn package comprising a package support for rotatably supporting at least one bobbin tube, means for delivering an advancing yarn to the at least one bobbin tube while it is supported upon the package support so as to form a yarn package thereupon, a contact roll, means mounting the package support and the contact roll so that the supported bobbin tube and the contact roll are rotatable about parallel axes and such that the contact roll engages the surface of a package being wound on the bobbin tube and such that the package support and the contact roll are relatively moveable in a direction wherein the center to center distance between the supported bobbin tube and the contact roll increases as the package builds, and means for sequentially gripping and releasing the mounting means so that the relative movement occurs discontinuously during movement in said direction.

12. The apparatus as defined in claim 11 wherein the package support includes a bracket which is mounted for pivotal movement about an axis which is parallel to the rotational axis of the supported bobbin tube, and wherein the contact roll is mounted for rotation about a fixed axis which is parallel to the axis of the supported bobbin tube, and wherein the means for sequentially gripping and releasing the mounting means sequentially engages and disengages said bracket.

13. The apparatus as defined in claim 12 wherein the bracket comprises a pair of arms connected to respective ends of the supported bobbin tube, and wherein the means for sequentially gripping and releasing the mounting means includes a gripping mechanism operatively connected to each of said arms.

14. The apparatus as defined in claim 13 wherein the means for gripping and releasing the mounting means further includes means for separately operating each of said gripping mechanisms.

15. The apparatus as defined in claim 11 wherein the package support comprises a spindle for coaxially receiving the supported bobbin tube and which is mounted to a revolver which is in turn mounted for rotation about an axis parallel to the axis of the spindle, and wherein the contact roll is rotatably mounted to a bracket which is mounted for pivotal movement about an axis which is parallel to the axis of the spindle, and wherein the means for gripping and releasing the mounting means sequentially engages and disengages said bracket.

16. The apparatus as defined in claim 15 further comprising a drive for rotating said revolver about its rotational axis in response to the build of a package upon said at least one bobbin tube while it is mounted upon the support spindle.

17. The apparatus as defined in claim 11 wherein said means for sequentially gripping and releasing the mounting means includes a pulse generator which is connected to a controller, and wherein the controller includes a program by which the gripping and releasing sequence may be varied.

18. The apparatus as defined in claim 11 wherein the means for sequentially gripping and releasing the mounting means comprises at least one gripping mechanism which includes a pin fixed to said mounting means and a gripping jaw positioned to selectively grip the pin.

19. The apparatus as defined in claim 18 wherein said at least one gripping mechanism further includes an actuator for selectively moving the gripping jaw against the pin.

20. The apparatus as defined in claim 11 wherein the means for delivering an advancing yarn to the at least one bobbin tube comprises drive means for rotating the supported bobbin tube about its rotational axis, and traversing means mounted at a location upstream of the supported bobbin tube for traversing the advancing yarn to form a cross wound package.

21. The apparatus as defined in claim 11 wherein the contact roll and the package support are mounted for limited relative movement toward and away from each other, and wherein the means for sequentially gripping and releasing the mounting means is operable in each direction of relative movement.

* * * * *